US006291153B1

(12) United States Patent
Dickerson

(10) Patent No.: US 6,291,153 B1
(45) Date of Patent: Sep. 18, 2001

(54) LOW SILVER HALIDE RADIOGRAPHIC FILM FOR DENTAL CARE

(75) Inventor: Robert E. Dickerson, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/604,032

(22) Filed: Jun. 27, 2000

Related U.S. Application Data

(63) Continuation-in-part of application No. 09/334,310, filed on Jun. 16, 1999.

(51) Int. Cl.[7] ..... G03C 1/035
(52) U.S. Cl. ..... 430/567; 430/569; 430/966
(58) Field of Search ..... 430/567, 569, 430/966

(56) References Cited

U.S. PATENT DOCUMENTS

| | | | | |
|---|---|---|---|---|
| 4,414,304 | | 11/1983 | Dickerson . | |
| 5,800,976 | | 9/1998 | Dickerson et al. . | |
| 5,866,309 | | 2/1999 | Fitterman et al. . | |
| 5,925,505 | | 7/1999 | Baugner et al. . | |
| 6,082,909 | * | 7/2000 | Fitterman et al. | 396/696 |
| 6,087,078 | * | 7/2000 | Fitterman et al. | 430/497 |
| 6,110,655 | * | 8/2000 | Fitterman et al. | 430/478 |

* cited by examiner

*Primary Examiner*—Janet Baxter
*Assistant Examiner*—Amanda C. Walla
(74) *Attorney, Agent, or Firm*—J. Lanny Tucker

(57) ABSTRACT

A direct radiographic film is usefull for dental care. The film contains lower than normal amounts of silver 30–45 mg/dm$^2$) and gelatino-vehicle 15–30 mg/dm$^2$) in each silver halide emulsion unit but retains the ability to provide desired sensitometric results. The film comprises predominantly non-spectrally sensitized silver bromide tabular grains.

12 Claims, No Drawings

LOW SILVER HALIDE RADIOGRAPHIC FILM FOR DENTAL CARE

This is a Continuation-in-Part of U.S. Ser. No. 09/334,310 filed Jun. 16, 1999 by Dickerson, now abandoned.

FIELD OF THE INVENTION

This invention relates to silver halide radiographic elements particularly adapted for use in dental imaging. More particularly, these radiographic elements contain lower silver than in conventional dental films.

BACKGROUND OF THE INVENTION

Roentgen discovered X-radiation by the inadvertent exposure of a silver halide photographic element. In 1913, Eastman Kodak Company introduced its first product specifically intended to be exposed by X-radiation (X-rays). Silver halide radiographic films account for the overwhelming majority of medical diagnostic images. It was recognized almost immediately that the high energy ionizing X-rays are potentially harmful, and ways were sought to avoid high levels of patient exposure. Radiographic films provide viewable silver images upon imagewise exposure followed by wet processing.

One approach, still in widespread practice is to coat a silver halide emulsion useful in radiographic films on both sides of the film support. Thus, the number of X-rays that can be absorbed and used for imaging are doubled, providing higher sensitivity. Dual-coated radiographic films are sold by Eastman Kodak Company under the trademark DUPLITIZED. Films that rely entirely on X-radiation absorption for image capture are referred in the art as "direct" radiographic elements, while those that rely on fluorescent intensifying screen light emission are referred to in the art as "indirect" radiographic elements.

Direct radiographic elements have various uses, such as in industrial applications where intensifying screens cannot be used for some reason (for example pipeline welds and turbine blades).

Another important application for direct radiographic elements is in dentistry where images of a patient's teeth and gums are made in order to provide desired diagnostic and preventative dental care. In dental diagnostic imaging a small piece of X-ray film, commonly referred to as "chip" mounted in a sealed opaque package is placed in a patient's mouth during X-ray exposure.

Copending and commonly assigned U.S. Ser. No. 09/007085 filed Jan. 14, 1998 by Baugher et al now U.S. Pat. No. 5,952,163, describes direct dental X-ray films that can be removed from the opaque packages after imagewise exposure and processed in room light. Those films are comprised of silver halide emulsion and protective layers that contain dye particles that can be decolorized during wet processing.

Copending and commonly assigned U.S. Ser. No. 09/087477 filed May 29, 1998, now U.S. Pat. No. 5,925,505, also describes and claims direct dental X-ray films that can be handled in ambient light.

Dental X-ray film is used worldwide in providing dental care. In many countries that are less industrialized or are considered "emerging" markets, cost of dental care is a great concern because of limited resources by dentists for purchasing materials and supplies. Many patients in those countries cannot pay for such services despite their need for them. As a result, there is a need to provide dental X-ray films that are less expensive, can be used with existing or lower cost processing systems, and that still provide desired sensitometric properties (for example, speed).

SUMMARY OF THE INVENTION

The problems noted above are overcome with a direct radiographic film comprising a support having disposed on one or both sides thereof, a silver halide emulsion unit comprising non-spectrally sensitized silver halide grains comprising at least 95 mol % bromide based on total silver and no more than 3 mol % iodide based on total silver, at least 50% of the silver halide grain projected area being provided by tabular grains having an average aspect ratio greater than 8, the coverage of silver in each silver halide emulsion unit being from about 30 to about 45 mg/dm$^2$, and the coverage of gelatino-vehicle in each silver halide emulsion unit being from about 15 to about 30 mg/dm$^2$.

The radiographic films of this invention are lower in cost because of the lowered coating of silver and gelatino vehicle, but the sensitometric results are very acceptable despite these unconventional changes. This was a surprise because it was expected that lowered silver coverage in the elements would result in lowered photographic sensitometric properties, for example lower photographic speed. That expectation is consistent with known teaching in the art that proposes that photographic speed in radiographic materials is largely influenced by the mass of the silver halide grains and silver coating coverage. The present invention achieves acceptable photographic speed despite having only about one-third the conventional amount of silver halide in each silver halide emulsion unit.

In addition, I found that it was important that the coating coverage of silver and gelatino-vehicle in each silver halide emulsion unit be carefully balanced. Thus, while the silver coverage has been lowered without loss of sensitometric results, the relationship of the gelatino-vehicle coverage to silver coverage is critical. If the gelatino-vehicle coverage is too high, a loss in speed is observed. If the coverage is too low, fog from drying can increase due to insufficient protection from the hydrophilic gelatino-vehicle.

DETAILED DESCRIPTION OF THE INVENTION

In the simplest possible construction a direct radiographic film according to the invention can take the following form:

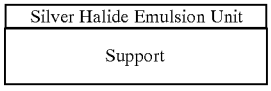

DXR-1

Since flexible supports are much more common than rigid supports, usually two silver halide emulsion units are coated on the support, as shown in the following preferred embodiment:

| |
|---|
| Silver Halide Emulsion Unit |
| Flexible Support |
| Silver Halide Emulsion Unit |

DXR-2

The following represents a specifically preferred embodiment of the invention having broad general applicability as dental films:

| |
|---|
| Protective Overcoat |
| Silver Halide Emulsion Layer |
| Transparent Film Support |
| Silver Halide Emulsion Layer |
| Protective Overcoat |

DXR-3

The support can take the form of any conventional radiographic element support. It should be transmissive. A single silver halide emulsion unit is particularly compatible with rigid supports (for example, a glass or metal plates), since a rigid support can withstand the forces applied to the support. In all embodiments in which silver halide emulsion unit is coated on only one side of the support, the support can be either X-radiation transmissive or X-radiation absorbing.

In the preferred DXR-2 embodiment, the silver halide emulsion units can include one or more silver halide emulsion layers and additional gel layers. Coating physical property modifying addenda can be present in either or both units. In such embodiments, the support can be either flexible or rigid, but must be X-radiation and light transmissive.

In the more preferred embodiments, the silver halide emulsion unit can contain two or more layers, with at least one of these layers being a silver halide emulsion layer. For example, each silver halide emulsion unit described above can be divided into two or three silver halide emulsion layers. In a preferred form, each unit containing a silver halide emulsion is comprised of a silver halide emulsion layer and at least one overlying protective layer (as shown in DXR-3). Each silver halide emulsion layer can be subdivided into two or more emulsion layers and each protective overcoat can be sub-divided into two or more individual layers. Protective overcoats are typically sub-divided into surface overcoats and interlayers.

The supports for the direct X-ray films of the invention can be chosen from among those disclosed by *Research Disclosure*, Item 38957, cited above, XV. Supports and *Research Disclosure*, Vol. 184, August 1979, Item 18431, XII. Film Supports. In the majority of applications the support is a transparent film support. In its simplest possible form the transparent film support consists of a transparent film chosen to allow direct adhesion of the hydrophilic colloid emulsion layers. More commonly, the transparent film is itself hydrophobic and subbing layers are coated on the film to facilitate adhesion of the hydrophilic emulsion layers. Typically the support is either colorless or blue tinted, tinting dye being present in one or both of the film and the subbing layers. Referring to *Research Disclosure*, Item 38957, Section XV Supports, cited above, attention is directed particularly to paragraph (2) that describes subbing layers, and paragraph (7) that describes preferred polyester film supports.

The silver halide emulsions useful in this invention contain silver halide grains responsive to X-radiation. Silver halide grain compositions contemplated include those having at least 95 mol % bromide (preferably 98 mol %) based on total silver. Such emulsions include grains composed of silver bromide, silver iodobromide, silver chlorobromide, silver iodochlorobromide, and silver chloroiodobromide, where halides are named in order of ascending concentrations. Iodide is generally limited to no more than 3 mol % to facilitate more rapid processing. Preferably iodide is limited to no more than 1 mol %, based on silver, or eliminated entirely from the grains.

In addition to the advantages obtained by composition selection described above it is specifically contemplated to employ silver halide grains that exhibit a coefficient of variation (COV) of average grain ECD (equivalent circular diameter) of less than 20% and, preferably, less than 10%. It is preferred to employ a grain population that is as highly monodisperse as can be conveniently realized. Further, it is preferred that the maximum average ECD of the tabular grains be less than 3.0 $\mu$.

In addition, at least 50% (and preferably at least 70%) of the silver halide grain projected area is provided by tabular grains having an average aspect ratio greater than 8, and preferably greater than 15. The average thickness of the grains is generally at least 0.10 and no more than 0.15 $\mu$m, and preferably at least 0.12 and no more than 0.14 $\mu$m. The average grain diameter is from about 1.5 to about 3 $\mu$m, and preferably from about 1.8 to about 2.4 $\mu$m.

Tabular grain emulsions that satisfy high bromide grain requirements and gelatino-vehicle requirements, are described in greater detail in the following patents, the disclosures of which are here incorporated by reference:

| | |
|---|---|
| Dickerson | US-A-4,414,310, |
| Abbott et al | US-A-4,425,425, |
| Abbott et al | US-A-4,425,426, |
| Kofron et al | US-A-4,439,520, |
| Wilgus et al | US-A-4,434,226, |
| Maskasky | US-A-4,435,501, |
| Maskasky | US-A-4,713,320, |
| Dickerson et al | US-A-4,803,150, |
| Dickerson et al | US-A-4,900,355, |
| Dickerson et al | US-A-4,994,355, |
| Dickerson et al | US-A-4,997,750, |
| Bunch et al | US-A-5,021,327, |
| Tsaur et al | US-A-5,147,771, |
| Tsaur et al | US-A-5,147,772, |
| Tsaur et al | US-A-5,147,773, |
| Tsaur et al | US-A-5,171,659, |
| Dickerson et al | US-A-5,252,442, |
| Zietlow | US-A-5,370,977, |
| Dickerson | US-A-5,391,469, |
| Dickerson et al | US-A-5,399,470, |
| Maskasky | US-A-5,411,853, |
| Maskasky | US-A-5,418,125, |
| Daubendiek et al | US-A-5,494,789, |
| Olm et al | US-A-5,503,970, |
| Wen et al | US-A-5,536,632, |
| King et al | US-A-5,518,872, |
| Fenton et al | US-A-5,567,580, |

-continued

| | |
|---|---|
| Daubendiek et al | US-A-5,573,902, |
| Dickerson | US-A-5,576,156, |
| Daubendiek et al | US-A-5,576,168, |
| Olm et al | US-A-5,576,171, and |
| Deaton et al | US-A-5,582,965. |

The patents to Abbott et al, Fenton et al, Dickerson and Dickerson et al are cited and incorporated by reference to show conventional element features in addition to the gelatino-vehicle, high bromide tabular grain emulsions and other critical features of the present invention.

A variety of dopants are known individually and in combination, to improve contrast as well as other common properties, such as speed and reciprocity characteristics. A summary of conventional dopants to improve speed, reciprocity and other imaging characteristics is provided by *Research Disclosure*, Item 36544, cited above, Section I. Emulsion grains and their preparation, sub-section D. Grain modifying conditions and adjustments, paragraphs (3), (4) and (5).

Low COV emulsions can be selected from among those prepared by conventional batch doublejet precipitation techniques. A general summary of silver halide emulsions and their preparation is provided by *Research Disclosure*, Item 36544, cited above, Section I. Emulsion grains and their preparation. After precipitation and before chemical sensitization the emulsions can be washed by any convenient conventional technique using techniques disclosed by *Research Disclosure*, Item 36544, cited above, Section III. Emulsion washing.

The emulsions can be chemically sensitized by any convenient conventional technique as illustrated by *Research Disclosure*, Item 36544, Section IV. Chemical sensitization. Sulfur, selenium or gold sensitization (or any combination thereof) are specifically contemplated. Sulfir sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred. Both silver bromide and silver iodide have significant native sensitivity within the blue portion of the visible spectrum. Hence, when the emulsion grains contain high (>50 mol %, based on total silver) bromide concentrations, spectral sensitization of the grains is not essential.

Instability which increases minimum density in negative-type emulsion coatings (i.e., fog) can be protected against by incorporation of stabilizers, antifoggants, antikining agents, latent-image stabilizers and similar addenda in the emulsion and contiguous layers prior to coating. Such addenda are illustrated by *Research Disclosure*, Item 36544, Section VII. Antifoggants and stabilizers, and Item 18431, Section II. Emulsion Stabilizers, Antifoggants and Antikinking Agents.

The silver halide emulsion and other layers forming the silver halide emulsion units on opposite sides of the support of the radiographic film contain conventional hydrophilic colloid vehicles (peptizers and binders) that are typically gelatin or a gelatin derivative (identified herein as "gelatino-vehicles"). Conventional gelatino-vehicles and related layer features are disclosed in *Research Disclosure*, Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin). Cationic starch used as a peptizer for tabular grains is described in U.S. Pat. No. 5,620,840 (Maskasky) and U.S. Pat. No. 5,667,955 (Maskasky).

The tabular grain emulsions, the radiographic elements of this invention are generally fully hardened using a conventional hardener. Thus, the amount of hardener in each silver halide emulsion unit is generally at least 1% and preferably at least 2%, based on the total dry weight of the gelatino-vehicle.

Conventional hardeners can be used for this purpose, including formaldehyde and free dialdehydes such as succinaldehyde and glutaraldehyde, blocked dialdehydes, a-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydro-quinoline, N-carbamoyl pyridinium salts, carbamoyl oxypyridinium salts, bis(imoniomethyl) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening finctional groups, polymeric hardeners such as dialdehyde starches, and copoly(acrolein-methacrylic acid).

In each silver halide emulsion unit in the radiographic film, the level of silver is generally at least 30 and no more than 45 mg/dm$^2$, and preferably at least 30 and no more than 40 mg/dm$^2$. In addition, the coverage of gelatino-vehicle is generally at least 15 and no more than 30 mg/dm$^2$, and preferably at least 15 and no more than 25 mg/dm$^2$. The amounts of silver and gelatino-vehicle on the two sides of the support can be the same or different. These amounts refer to dry weights.

The radiographic films generally include a surface overcoat on each side of the support that is typically provided for physical protection of the emulsion layers. In addition to vehicle features discussed above the protective overcoats can contain various addenda to modify the physical properties of the overcoats. Such addenda are illustrated by *Research Disclosure*, Item 36544, Section IX. Coating physical property modifying addenda, A. Coating aids B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers.

The protective overcoat is generally comprised of a hydrophilic colloid vehicle, chosen from among the same types disclosed above in connection with the emulsion layers. In conventional radiographic films protective overcoats are provided to perform two basic finctions. They provide a layer between the emulsion layer and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions. The protective overcoats can include the features disclosed by *Research Disclosure*, Item 18431, cited above, IV. Overcoat Layers, and can also include addenda (including coating aids, plasticizers and lubricants, antistats and matting agents) disclosed by *Research Disclosure*, Item 38957, IX. Coating physical property modifying addenda The radiographic films of this invention can also be modified so that they can be handled in ambient light. For example, U.S. Ser. No. 09/087,477 and U.S. Ser. No. 09/007085 (both noted above) describe the inclusion of light-absorbing dyes that can be decolorized during wet processing. The dye particles provide an average density of greater than 3.0 over a spectral range of above 320 nm (particularly from 320 to 540 nm) over which the silver halide exhibits an absorption coefficient of at least 0.5 $cm^{-1}$. These dyes can be located in a silver halide emulsion layer or in a protective layer located between a silver halide emulsion layer and the source of actinic radiation. They may be located on both sides of the support if desired. It is particularly useful to use particulate dyes that serve this purpose. The noted copending applications describe a variety of such useful dyes and the typical processing solutions that can be used to decolorize them.

Exposure and processing of the direct X-ray films of the invention can be undertaken in any convenient conventional manner. The exposure and processing techniques of U.S. Pat. No. 5,370,977 (noted above), are typical for processing dental direct X-ray films. The exposure and processing techniques of U.S. Pat. No. 4,480,024 (Lyons et al) and U.S. Pat. No. 4,707,435 (Lyons et al), incorporated herein by reference, are typical for processing industrial direct X-ray films.

The following examples are provided for illustrative purposes, and are not meant to be limiting in any way.

EXAMPLE

The general configurations of the films were as shown above for DXR-3 with a overcoat and silver halide emulsion layer coated on each side of a blue-tinted poly(ethylene terephthalate) filn support (178 $\mu$m thickness).

Film A:

| Protective Overcoat: | |
|---|---|
| Gelatin | 13.5 mg/dm$^2$ |
| Poly(methyl methacrylate) matter beads | 0.9 mg/dm$^2$ |
| TRITON X-200 surfactant | 0.8 mg/dm$^2$ |
| LODYNE S-100 surfactant | 0.08 mg/dm$^2$ |

Silver Halide Emulsion Layer:

AgBr tabular grain emulsion in which tabular grains accounted for greater than 50 percent of total grain projected area. The mean grain ECD was 1.8 $\mu$m and the mean thickness of the tabular grains was 0.13 $\mu$m. The "BWM" latex polymer was poly(n-butyl acrylate-co-isopropylmethacryl-amide-co-methylacrylamide). "APMT" was a 1-(3-acetamidophenyl-5-mercapto)tetrazole. "MeS-TAI" was 4-hydroxy-6-methyl-2-methylmercapto-1,3,3a,7-tetraazaindene.

| | |
|---|---|
| Silver bromide | 94.5 mg Ag/dm$^2$ |
| Gelatin | 49 mg/dm$^2$ |
| Dextran P | 15 mg/dm$^2$ |
| BWM latex polymer | 11 mg/dm$^2$ |
| Sorbitol | 6 mg/dm$^2$ |
| MeS-TAI | 2.1 g/Ag mole |
| Catechol disulfide | 2 mg/dm$^2$ |
| APMT | 0.1 mg/dm$^2$ |
| 6-Chloro-4-nitrobenzotriazole | 0.021 mg/dm$^2$ |
| Potassium tetrachloroaurate | $1 \times 10^{-6}$ mg/dm$^2$ |

Both the protective overcoats and silver halide emulsion layers were hardened by adding to each silver halide emulsion layer bis(vinyl-sulfonylmethyl)ether hardener at a concentration of 2.4% (based on the total gelatin weight) in both the silver halide emulsion layer and the protective overcoat on each side of the support.

Chemical Sensitization:

The AgBr emulsions used in Film A were sulfur and gold chemically sensitized using the following chemicals, bracketed amounts are in units of mg/Ag mole:

4,4'-phenyl disulfide diacetanilide [1]

potassium tetrachloroaurate [3.3]

sodium thiocyanate [150]

5,6-dimethyl-3(3-sulfopropyl)benzo-thiazolium inner salt [20]

sodium thiosulfate [3.3]

potassium selenocyanate [0.44]

Chemical sensitization was accomplished by adding these chemicals in sequential order at 40° C. and heating to 60° C. at a rate of 5° C. per 3 minutes and then held at 60° C. for 15 minutes. After the appropriate digestion, the silver halide emulsion was chilled rapidly with stirring until chill set.

Film B:

Film B was prepared like Film A except slightly larger tabular grains were used in the silver halide emulsion layers. The tabular grain size was 2.0 $\mu$m×0.13 $\mu$m.

Film C:

Film C was prepared like Film A except that Dextran P and the "BWM" latex polymer were omitted from the silver halide emulsion layers.

Film D:

Film D was prepared like Film C except that the amount of gelatin in each silver halide emulsion layer was 43.2 mg/dm$^2$.

Film E:

Film E was prepared like Film C except that the amount of gelatin in each silver halide emulsion layer was 32.4 mg/dm$^2$.

Film F:

Film F was prepared like Film D except that the silver level in each silver halide layer was 54 mg/dm$^2$.

Film G:

Film G was prepared like Film F except that the silver level in each silver halide layer was 43.3 mg/dm$^2$.

Film H:

Film H was prepared like Film G except that the gelatin level in each silver halide emulsion layer was 21.6 mg/dm$^2$.

Film I:

Film I was prepared like Film H except that the silver level in each silver halide layer was 32.2 mg/dm$^2$ and the gelatin level on each side was 16.1 mg/dm$^2$.

The various films were exposed and wet processed to provide black-and-white images as follows:

Exposures:

Dental X-ray exposures of samples of each film were made using a commercially available Phillips MC324 X-ray generator operating at 80 KvP with 0.6 mm aluminum filtration varying either current (milliamperes) or time. Sensitometric gradations in exposure were achieved using a 21-increment (0.1 log E) aluminum step wedge of varying thickness.

Samples of the films were also exposed with Co-60 to simulate the effect of naturally occurring background radiation (from cosmic rays and terrestrial radioactivity). Thus, Co-60 exposures are considered a good predictor for fog increases resulting from natural keeping of dental films. For these examples, gamma rays from a Co-60 source were collimated toward the film samples (typically 2–3 meters distance form the gamma ray source). Pieces of acrylic plastic, large enough to completely cover the film samples and thick enough (about 3 mm) to create charge equilibrium, were placed in front of and behind the films samples. During the exposure, the electrons from the air and from the acrylic plastic impact the film samples silver halide emulsions. Typically, the films were exposed to 25, 50, 100 and 200 milliRems (mRems) to simulate the effect of different levels of background radiation. An exposure of 200 mRems would be a "worst case" simulation.

Processing:

The film samples were wet processed using a commercially available KODAK RP X-OMAT Processor M6A-N. The film samples were processed for 90 seconds using a developer solution comprising hydroquinone (30 g), phenidone (1.5 g), potassium hydroxide (21 g), $NaHCO_3$ (7.5 g), potassium sulfite (44.2 g), $Na_2S_2O_5$ (12.6 g), sodium bromide (35 g), 5-methylbenzotriazole (0.06 g), glutaraldehyde (4.9 g), and water to 1 liter (pH 10). Fixing was done using commercially available KODAK RP X-OMAT Fixer, and the processed film samples were then dried.

Results:

The results of both dental X-ray and Co-60 exposures are shown in TABLE I below (which also summarizes the silver and gelatin levels in each silver halide emulsion layer).

It can be seen that Film A, which is a conventional dental film, contains relatively high levels of silver to maintain satisfactory speed and contrast. Films B, C and E show conventional attempts to increase speed from that exhibited by Film A.

Films D, E, F, and G are outside the present invention even though the silver and/or gelatino-vehicle coverages are reduced in some of them. Film D showed some loss in speed. Film E had increased speed as well as a loss in contrast, increased fog and increased sensitivity to fogging during keeping. Film F exhibited improved sensitivity to fogging during keeping, but has showed reduced speed. Film G also exhibited reduced speed.

Films H and I are films within the present invention with considerably lowered coverages of silver and gelatino-vehicle. While there was a slight increase in fog in Film H, it had acceptable speed and contrast and considerably increased resistance to fogging during storage.

Film I exhibited acceptable speed, contrast and $D_{min}$ and improved storage stability (resistance to fogging during storage).

It is also apparent from the Co-60 exposure results that the films of this invention have improved natural age keeping because of the lowered background fog levels.

TABLE I

| FILM | SILVER (mg/dm$^2$) | GELATINO-VEHICLE (mg/dm$^2$) | SPEED | CONTRAST | FOG | Co-60 EXPOSURE (200 mRems) |
|---|---|---|---|---|---|---|
| A | 94.5 | 51.3 | 260 | 1.9 | 0.20 | not available |
| B | 94.5 | 51.3 | 272 | 1.9 | 0.20 | 0.358 |
| C | 94.5 | 51.3 | 309 | 1.9 | 0.21 | 0.448 |
| D | 64.8 | 43.2 | 258 | 1.9 | 0.20 | 0.271 |
| E | 64.8 | 32.4 | 303 | 1.6 | 0.24 | 0.460 |
| F | 54 | 32.4 | 266 | 1.8 | 0.21 | 0.265 |
| G | 43.2 | 32.4 | 234 | 1.8 | 0.20 | 0.255 |
| H (Invention) | 43.2 | 21.6 | 261 | 1.7 | 0.23 | 0.173 |
| I (Invention) | 32.2 | 16.1 | 267 | 1.6 | 0.23 | 0.150 |

The invention has been described in detail with particular reference to preferred embodiments thereof, but it will be understood that variations and modifications can be effected within the spirit and scope of the invention.

I claim:

1. A direct radiographic film comprising a support having disposed on one or both sides thereof, a silver halide emulsion unit comprising non-spectrally sensitized silver halide grains comprising at least 95 mol % bromide based on total silver and no more than 3 mol % iodide based on total silver, at least 50% of the silver halide grain projected area being provided by tabular grains having an average aspect ratio greater than 8, the cover of silver in each silver halide emulsion unit being from about 30 to about 40 mg/dm$^2$, and of gelatino-vehicle in each silver halide emulsion unit being from about 25 mg/dm$^2$.

2. The film of claim 1 comprising a silver halide emulsion unit on each side of said support.

3. The film of claim 1 wherein each of said silver halide emulsion units comprises at least one silver halide emulsion layer and a protective overcoat.

4. The film of claim 1 wherein said silver halide emulsion unit comprises at least 98 mol % bromide based on total silver.

5. The film of claim 1 wherein said silver halide emulsion unit comprises no more than 1 mol % iodide based on total silver.

6. The film of claim 1 wherein at least 70% of the silver halide grain projected area is provided by tabular grains having an average aspect ratio greater than 8.

7. The film of claim 1 wherein said silver bromide tabular grains have an average thickness of from 0.1 to 0.15 $\mu$m.

8. The film of claim 7 wherein said silver bromide tabular grains have an average thickness of from 0.12 to 0.14 $\mu$m.

9. The film of claim 1 wherein said silver bromide tabular grains have a diameter of from about 1.5 to about 3 $\mu$m.

10. The film of claim 1 comprising at least one silver halide emulsion layer comprising a sulfur, selenium or gold chemical sensitizer.

11. The film of claim 10 comprising at least one silver halide emulsion layer comprising a sulfur chemical sensitizer.

12. The film of claim 1 wherein said silver halide emulsion unit comprises at least one silver halide emulsion layer comprising at least 1% hardener, based on total dry weight of said gelatino-vehicle.

* * * * *